United States Patent [19]

Datsenko et al.

[11] 4,187,172

[45] Feb. 5, 1980

[54] APPARATUS FOR THE SEPARATION OF TRASH FROM LESS HEAVY FIRM ARTICLES IN A FLOW OF LIQUID

[76] Inventors: Nikolai M. Datsenko, ulitsa Frunze 131, kv. 16; Nikolai N. Pushanko, ulitsa Uritskogo 9, kv. 137; Vladimir G. Yarmilko, ulitsa Zatonskogo, kv. 78, all of Kiev, U.S.S.R.

[21] Appl. No.: 937,933

[22] Filed: Aug. 30, 1978

[51] Int. Cl.[2] ..... B07C 3/04

[52] U.S. Cl. ..... 209/44.3; 209/664; 209/906; 209/632

[58] Field of Search ..... 209/664, 683, 906, 632, 209/634, 13, 16, 17, 44.1, 44.3

[56] References Cited

U.S. PATENT DOCUMENTS

| | | | |
|---|---|---|---|
| 1,747,645 | 2/1930 | Palmer | 209/664 X |
| 2,687,801 | 8/1954 | Jackson | 209/664 X |
| 3,322,274 | 5/1967 | Fox | 209/664 |

FOREIGN PATENT DOCUMENTS

| | | | |
|---|---|---|---|
| 1047549 | 12/1953 | France | 209/13 |
| 1336912 | 11/1973 | United Kingdom | 209/17 |

*Primary Examiner*—Allen N. Knowles
*Attorney, Agent, or Firm*—Lackenbach, Lilling & Seigel

[57] ABSTRACT

The apparatus serves the purpose of separating trash from less heavy firm articles in a flow of liquid. It has a casing wherein a horizontal revolving screen is located with members which impart motion to trash. Accommodated in the casing coaxially with the revolving screen is a contrivance for the separation, feeding and discharging of trash which is attached to the revolving screen at the end thereof where the flow of liquid carrying the uncleaned firm articles enters the revolving screen. The contrivance consists of an outward cylinder and an inward cylinder. The outward cylinder is provided with ports through which the outflow of liquid and the smaller particles of trash from the revolving screen are fed. Ports provided in the inward cylinder serve to admit the greater particles of trash and discharge all the trash separated. Partitions subdivide the space between the cylinders into passages extending transversely with respect to the longitudinal axis of the contrivance. Each of the passages opens into a corresponding port of the inward cylinder and into a port of the outward cylinder. At least one additional cylinder is coaxially disposed between the outward cylinder and the inward cylinder and provided with ports. At least three passages are formed in each, one length of each being defined by the side surfaces of the outward cylinder and the additional cylinder and another length being defined by the side surfaces of the additional cylinder and the inward cylinder.

6 Claims, 3 Drawing Figures

APPARATUS FOR THE SEPARATION OF TRASH FROM LESS HEAVY FIRM ARTICLES IN A FLOW OF LIQUID

FIELD OF THE INVENTION

The present invention relates to cleaning equipment and, more specifically, to apparatus for the separation of trash from less heavy firm articles in a flow of liquid.

The apparatus for the separation of trash from less heavy firm articles in a flow of liquid provided in accordance with the invention can be used to advantage in removing trash from tubers and various root crops, such as potato and sugar beet, and may find application at sugar and starch factories as well as at distilleries using beet and potato as a raw material. The invention is of practical significance to agriculture where it can give serve as a means of cleaning tubers and root crop used as fodder. Catering is another field of application where the apparatus can be used to clean vegetables, centralized fashion. It is also useful in other industries where the separation of trash from a less heavy lump material displaced by a flow of liquid is required.

The recent headway made in mechanizing the cultivation and harvesting of tubers and root crops has created a demand for apparatus for the separation of these products from trash, such as stones and sand, which operate effectively and economically.

DESCRIPTION OF THE PRIOR ART

Widely known in the art is an apparatus for the separation of trash from less heavy firm articles in a flow of liquid. This apparatus is provided with a horizontal revolving screen working in a through-shaped casing and secured to a shaft by spokes. Helical ribbons attached to the screen on the inside and outside thereof serve to impart motion to the trash inside both the revolving screen and casing.

A contrivance for the separation, feeding and discharging of trash is attached to the revolving screen at the end thereof where the flow of liquid carrying firm articles along with trash enters the revolving screen from a flume. This contrivance consists of two coaxial cylinders separated by a space confined at the sides by flat annular walls the inner diameter of which being equal to the diameter of the revolving screen. The diameter of the inward cylinder is somewhat greater than that of the screen.

The outward cylinder is provided with two ports located at diametrically opposite points and serving to feed the outflow of liquid and smaller particles of trash from the revolving screen into the contrivance.

The inward cylinder is provided with two ports located at diametrically opposite points, their function being the reception of greater particles of trash, i.e., stones, and the discharge of all the trash separated into an immovable chute secured to the upper part of the casing.

The contrivance is also provided with partitions running parallel to the longitudinal axis of the apparatus next to the ports of the inward cylinder. Subdividing the space between the cylinders into two passages, these partitions provide space where trash can accumulate. The passages so formed extend transversely relative to the longitudinal axis of the contrivance and are bordered by the side walls of the inward and outward cylinders. Each of the passages has a cross-sectional area which is essentially the same all along the length thereof and is approximately equal to the area of one of the ports in the inward cylinder. Owing to that the velocity of the ascending flow of liquid can be maintained at the level required to keep the tubers or root crop suspended, thus preventing them from escaping through the ports of the inward cylinder along with trash. Denoted as the ascending flow is that part of the main flow which is diverted, when the apparatus is in operation, from the casing into a port of the outward cylinder, goes down the passage and through a port of the inward cylinder where it is directed by the longitudinal partition, located next to this port, towards the longitudinal axis of the revolving screen, and flowing thence almost at right angles to the plane of the port of the inward cylinder. The length of each passage is roughly equal to half the circumference of the outward cylinder, and each passage opens into a port of the inward cylinder with one end and into a port of the outward cylinder with the other end.

The most serious disadvantage of the known apparatus for the separation of trash from less heavy firm articles in a flow of liquid is the lack of effectiveness in removing such trash as small stones. The reason is that under the conditions of the velocity of the ascending flow passing through a port in the inward cylinder of the contrivance, which is adequate in preventing the tubers or root crop from being separated from the flow, the smaller particles of trash are, however, kept suspended and consequently carried away by the flow of liquid in spite of their high density.

Another disadvantage of the known apparatus is the failure of the two longitudinal partitions accumulating trash to discharge all the trash separated when the tubers or root crop treated are impure as this may be the case when it is grown in stony soil. The reason is that in the known apparatus the partitions provided in the passages are disposed at a small angle to the radius of the inward cylinder. To increase the discharging capacity of the apparatus it may appear desirable to increase said angle, yet a substantial increase is impractical for not all the trash which has accumulated is capable of discharging when the partition is in its upper position and is consequently carried away by the flow of liquid.

SUMMARY OF THE INVENTION

A main object of the present invention is to provide an apparatus for the separation of trash from less heavy firm articles in a flow of liquid wherein the passages and partitions are available in a number assuring a more complete than ever before separation of the trash.

Another object of the present invention is to provide an apparatus for the separation of trash from less heavy firm articles in a flow of liquid which will enable a more complete than ever before discharge of the trash separated.

These objects are attained by an apparatus for the separation of trash from less heavy firm articles in a flow of liquid in a trough-shaped casing. There are located in the casing a horizontal revolving screen with members imparting motion to trash and a contrivance for the separation, feeding and discharging of trash which is attached to the revolving screen at the end thereof where the flow of liquid carrying the uncleaned articles enters said screen. The contrivance is made up of two coaxial cylinders, the inward cylinder being of a diameter somewhat greater than the diameter of the revolving screen, the cylinders being separated by a space. Ports are provided in the outward cylinder through which the outflow of liquid and the smaller particles of trash from the revolving screen enter the contrivance. Ports are provided in the inward cylinder through which the larger particles of trash are fed and through which all the trash separated is discharged. Also provided are longitudinal partitions disposed next to the ports of the inward cylinder for the purpose of accumulating trash thereon which subdivide the space between the cylinders into passages running transversely with respect to the longitudinal axis of the contrivance each partition having an essentially constant cross-sectional area throughout the entire length thereof which is essentially equal to half the circumference of the outward cylinder, and each partition extending to a corresponding port of the inward cylinder at one end and to a port of the outward cylinder at the other end. In accordance with the invention the contrivance incorporates at least one additional cylinder interposed between the outward cylinder and the inward cylinder coaxially with them and provided with ports next to the longitudinal partitions and at least three passages, one surface of each such passage being formed by the side surfaces of the outward cylinder and of the additional cylinder, a second surface length—communicating with the first surfaces through a corresponding port of the additional cylinder—being formed by the side surfaces of the additional cylinder and of the inward cylinder, and each of the longitudinal passages being located between the inward cylinder and the additional cylinder.

A system of passages and partitions like this one assures a more complete than ever before separation of the heavy trash of all particle sizes and a more complete than ever before discharge of the trash separated when the firm articles cleaned are particularly impure.

It is expedient that the first and second surfaces of the additional cylinder be displaced relative to each other along the longitudinal axis of the contrivance so that the first surface is located within its width behind the second surface along the longitudinal axis of the contrivance.

Owing to this arrangement the increase in the number of passages results in almost no increase in the outside diameter of the contrivance while the cross-sectional area of the passages is retained as required.

It is further expedient that at least on port of the additional cylinder have an area which is less than the area of each port of the inward cylinder and that one port of the inward cylinder have an area which is greater than the area of each of the rest of the ports thereof and is provided with a grating.

By virtue of said layout of the passages and ports in the inward cylinder, the velocity of the ascending flow in at least one of the ports is less than in the rest of the ports, whereby favourable conditions are created for the separation of the smaller particles of a size which is greater than the mesh of the revolving screen, but smaller than the size of the firm articles cleaned while the density of said particles is greater than that of the articles. The grating at the port prevents the more sizable firm articles cleaned from leaving through the port along with the trash.

It be also expedient that the grating at a port of the inward cylinder is formed by bars bent to a radius which is somewhat smaller than the radius of the inward cylinder, and extend in a direction which is essentially a transverse one relative to the axis of the contrivance attached. One end of each of the bars is attached to a edge of the port in the inward cylinder, and the other ends are free and separated by a gap from the opposite edge of said port. The bars have a longitudinally changing cross-sectional area which gradually diminishes towards the free ends.

A grating of such construction assures unhampered discharge of the trash separated in the course whereof the comparatively coarser particles roll down the bent bars of the grating when the port is in its topmost position. The longitudinally changing cross sectional area of the bars prevents the sticking of the trash and articles cleaned between bars.

It is preferred that a chute be provided at the end of the apparatus into which enters the flow of liquid carrying the uncleaned firm articles enters, said chute being attached to the casing so as to divert some of the flow of liquid directly into the three passages of the contrivance and being provided with a grating fitted essentially horizontally to the upper open part of the chute.

This is conducive to diverting a fraction of the flow of liquid directly into the passages of the contrivance. Owing to the presence of the chute and the gratings, some of the trash is caused to settle at the inlet of the flow of liquid into the apparatus where it passes through the grating and enters the casing by way of the chute, moving eventually through the passages of the contrivance and by-passing the revolving screen. This is conducive to a more complete than ever before removal of sand and other small-sized trash from firm articles.

It is also preferable that the grating of the chute be formed by bars extending along the longitudinal axis of the contrivance and having one end attached, to the chute and the other ends free and separated from the casing of the apparatus by a gap, the bars being of a longitudinally changing cross-sectional area which gradually diminishes towards the free ends.

A grating like this one prevents the sticking of trash between the bars. The attachment of the bars at just one end thereof and the changing cross-sectional area of the bars enable the cleaning of the grating of the trash stuck between the bars by means of firm articles carried by the flow of liquid.

The apparatus for the separation of trash from less heavy firm articles in a flow of liquid provided in accordance with the invention is conducive to improving the effectiveness of the separation of trash and small stones by a considerable amount and to increasing the capacity of the apparatus in discharging the trash separated, thereby enabling the cleaning of firm articles with a high trash content.

The apparatus disclosed is adequately reliable in operation, comparatively simple in manufacture and requires no skilled attendants. It can be installed to operate in conjunction with underground and surface flumes without occupying special floor area.

BRIEF DESCRIPTION OF THE DRAWINGS

A preferred embodiment of the present invention will now be described by way of example with reference to the accompanying drawings in which.

DETAILED DESCRIPTION OF THE INVENTION

Figure 1:
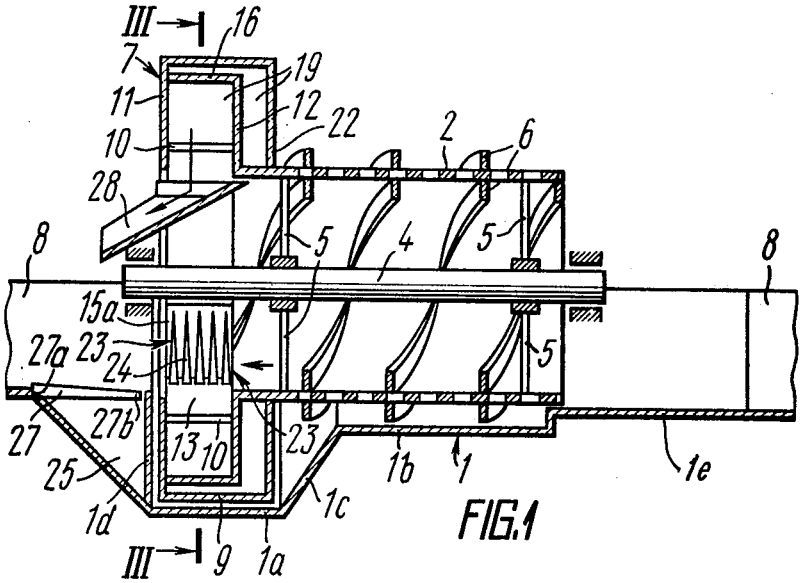
FIG. 1 is a sectional, elevational view of the apparatus for the separation of trash from less heavy firm articles in a flow of liquid, in accordance with the invention.
Figure 2:
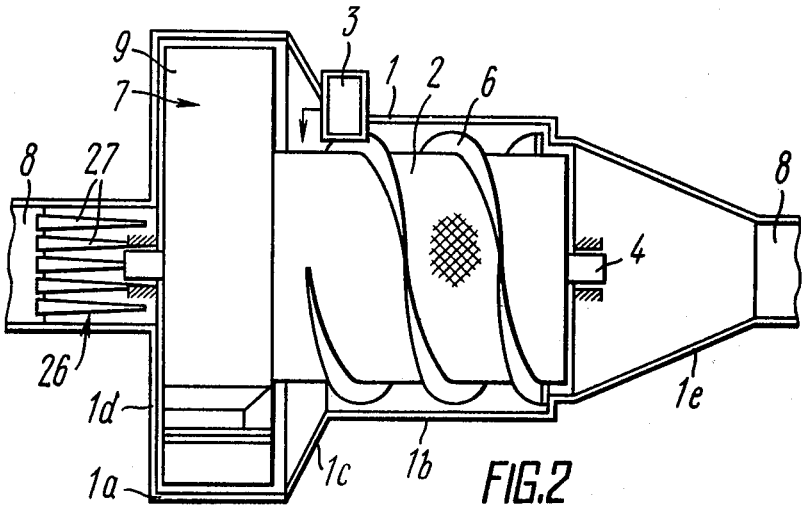
FIG. 2 is a top, plan view of the apparatus disclosed.

Referring to FIGS. 1 and 2, the apparatus for the separation of trash from less heavy firm articles provided in accordance with the invention incorporates a casing 1 of a trough-like shape changing longitudinally from a first cylindrical body 1*a* of a greater diameter to a second cylindrical body 1*b* of a smaller diameter interlinked by an intermediate taper wall 1*c*. The casing 1 is provided with a side wall 1*d* at the end where the flow of liquid enters same and with a tapering part 1*e* at the end where the flow of liquid is discharged.

Located inside the casing 1 is a horizontal revolving screen 2 with cylindrical side walls also shown at 2 geared to a drive 3 (FIG. 2) of any suitable design. The revolving screen 2 is mounted on a shaft 4 with the aid of radial spokes 5 (FIG. 1). Secured to the side wall of the screen 2 both on its inside and outside are members 6 which are helical ribbons designed to impart motion to the trash displacing therealong.

Attached to the revolving screen 2 is a contrivance 7 serving the purpose of separating, feeding and discharging trash which is mounted coaxially with the revolving screen 2 at the end thereof where the flow of liquid carrying unclean firm articles, i.e., tubers or root crop in the case under the consideration, enters the revolving screen 2 from a flume 8.

Figure 3:
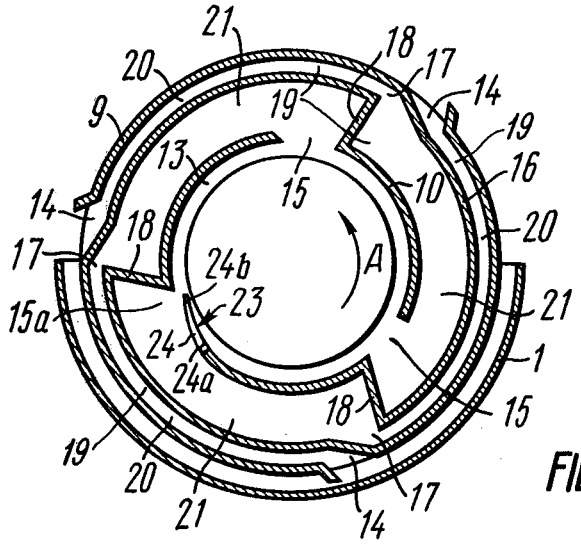
FIG. 3 is a sectional view taken along the line III—III of FIG. 1.

The contrivance 7 consists of two coaxial cylinders, an outward cylinder 9 and an inward cylinder 10 (FIG. 3), separated by a space which is limited by flat annular walls 11 and 12 (FIG. 1) at the end faces. The diameter of the inward cylinder 10 is somewhat greater than that of the revolving screen 2 and the inside diameter of the annular walls 11 and 12 is equal to that of the revolving screen 2 so that, owing to these relationships between the diameters, a recess 13 is formed inside the contrivance 7 (FIG. 1 and 3).

The outward cylinder 9 is provided with three ports 14 (FIG. 3) spaced equidistantly around the circumference and serving as inlets into the contrivance 7 for the liquid and smaller particles of trash outflowing from the revolving screen 2. The inward cylinder 10 is also provided with three ports 15 spaced equidistantly along the circumference and serving as inlets for the coarser particles of trash and as an outlet through which all the trash separated is discharged.

In the space between the cylinders 9 and 10 is provided an additional or middle coaxial cylinder 16 also with three ports 17 spaced equidistantly along its circumference.

The contrivance 7 is provided with partitions 18 running along the longitudinal axis thereof between the inward cylinder 10 and the additional cylinder 16. The partitions 18 provide space where trash can accumulate, and each partition 18 contacts the rear—looking in the direction of rotation of the contrivance 7 indicated by arrow A—edge of the corresponding port 15 being at the same time inclined relative to a radial plane passing through said edge in the direction which is opposite to the direction of rotation. Owing to that, a more complete than ever before discharging of the trash accumulated on the partitions 18 is assured.

Each partition 18 also contacts the forward-looking in the direction of rotation of the contrivance 7-edge of the corresponding port 17 in the additional cylinder 16 so that the ports 15 and 17 are located on opposite sides of the partition 18.

The contrivance 7 is also provided in accordance with the invention with three shaped passages 19 extending in the space between the inward cylinder 10 and the outward cylinder 9. These passages 19 run in a direction which is the transverse to the longitudinal axis of the contrivance 7, and each of the passages 19 is of constant cross-sectional area along the entire length which is essentially equal to half the circumference of the outward cylinder. Each passage 19 has one end opening into the corresponding port 15 of the inward cylinder 10 and the other end opening into a port 14 of the outward cylinder 9.

A length 20 of each passage 19 is formed by side surfaces of the outward cylinder 9 and the additional cylinder 16. Another length 21 of each passage 19 is formed by side surfaces of the additional cylinder 16 and the inward cylinder 10, and the length 21 of each passage 19 communicating with the length 20 thereof through the corresponding port 17 of the additional cylinder 16.

In addition, the length 20 of each passage 19 is displaced along the longitudinal axis of the contrivance 7 in the direction of the revolving screen with respect to the length 21 and, furthermore, the length 20 of each passage 19 is located the length 21 of another passage 19 and is closed at the end face by a plate 22 arranged transversely with respect to the longitudinal axis of the contrivance 7 between the outward cylinder 9 and the revolving screen 2. Owing to this arrangement the cross-sectional area of each passage 19 is constant along the entire length thereof. The side wall of the revolving screen 2 between the annular wall 12 of the contrivance 7 and the transverse plates 22 is made solid.

One of the ports 17 of the additional cylinder 16 is given an area which is smaller than the area of each port 15 of the inward cylinder 10. One of the ports 15, namely that shown at 15*a*, is of an area greater than the area of each of the rest of the ports 15. Owing to that, the velocity of the ascending flow, i.e., the outflow of liquid from the ports 15 of the inward cylinder 10 towards the longitudinal axis of the contrivance 7, when the apparatus is in operation, is smaller in the port 15*a* than the velocity of the ascending flow passing through the rest of the ports 15, and, consequently, a more complete than ever before removal of the smaller particles, which are unable to pass through the revolving screen 2 but are smaller than the tubers or root crop cleaned, is attained. At a greater velocity, whereat the tubers or root crop are maintained suspended, no total separation of these trash is achievable.

The port 15*a* is provided with a grating 12 made of bars 24 (FIGS. 1 and 3) bent to a radius smaller than the radius of the inward cylinder 10. The bars 24 extend transversely with respect to the longitudinal axis of the contrivance 7 and are attached to an edge of the port 15*a* with their ends 24*a*, the other ends 24*b* of the bars 24 being unattached and separated by a gap from the opposite edge of the port 15*a*, raising above said edge by some amount. The changing cross-sectional area of the bars 24 has a circular shape and gradually diminishes towards the free ends 24*b*. In another embodiment the cross-sectional area may have trapezoidal shape.

The grating 23, owing to the way it is constructed, prevents tubers or root crop from entering the port 15*a* along with the trash and assures a more complete than ever before discharge of the trash through the port 15*a*, because, when the port 15*a* is in the uppermost position, the greater particles of trash roll down and drop into the gap between the free ends of the bars and the edge of the port. The changing cross-sectional area of the bars 24 prevents the sticking of greater trash and tubers or root crop between the bars.

In accordance with the invention, a chute 25 (FIG. 1) attached to the casing 1 of the apparatus and to the flume 8 is provided at that end of the apparatus where the flow of liquid enters same. This chute 25 diverts some of the flow of liquid directly into the three passages 19 of the contrivance 7, thereby permitting an increase in amount of liquid admitted into the passages 19. This is conducive to increasing the effectiveness of the apparatus in operation.

The chute 25 is provided with a grating 26 (FIG. 2) fitted horizontally to the upper open part of the chute 25 so as to give support to the tubers or root crop and separate therefrom some of the smaller trash moving along the bottom of the flume 8 which is then diverted directly into the passages 19. The flow of liquid passing through the grating 26 into the chute 25 and moving towards the passages 19 assures the separation of trash by means of said grating in the most effective way.

The grating 26 of the chute 25 is formed by bars 27 extending along the longitudinal axis of the contrivance 7 and secured to the chute 25 with one of its ends, the other end of each bar being left unattached and separated from the casing 1 of the apparatus by a gap. The bars 27 are of a trapezoidal cross-sectional area which diminishes towards the free ends 27*b*. Owing to this arrangement of the bars 27, no trash and tubers or root crop is stuck between the bars and the spaces between the bars 27 always remain open.

Arranged at the top of the contrivance 7 is a chute 28 (FIG. 1) attached to the casing 1 with the aid of uprights (not shown). The chute is stationed below the ports 15 of the inward cylinder 10, when these ports are in their topmost position in the drawing, and serves the purpose of receiving the trash rolling down the inclined partitions 18 and through the ports 15 of the inward cylinder 10.

The apparatus for the separation of trash from less heavy firm articles in a flow of liquid provided in accordance with the present invention operates according to the following principles.

A flow of liquid carrying tubers or root crop along with the trash is fed from a source (not shown) over the flume 8 connected to the casing 1 of the apparatus from where it is directed into the revolving screen 2 operated by the drive 3.

In the revolving screen 2, where the cross-sectional area of the flow increases compared with the area thereof in the flume 8, the velocity of the flow sharply decreases and the more heavier trash settles in the flow along the apparatus. That trash which has settled along the length of the contrivance 7 comes directly into the bottom part of the annular recess 13 and the trash which has settled along the length of the revolving screen 2 is caused by the helical ribbons 6, available inside the revolving screen 2, to move also towards the contrivance 7 where it drops into the annular recess 13. As the revolving screen 2 continues to rotate integrally with the contrivance 7, the heavy trash accumulated in the annular recess 13 is fed into the length 20 of a corresponding passage 19 when a corresponding port 15 or 15*a* comes into its lowermost position.

To prevent tubers or root crop from entering the passage 19 by way of the port 15 or 15*a* along with the separated heavy trash, a flow of liquid—referred to as the ascending flow—is formed in the ports 15 and 15*a* when the revolving screen 2 and the contrivance 7 rotate, being directed opposite to the direction in which the separated heavy trash is progressing while being fed from the annular recess 13 into the length 20 of a corresponding passage 19 through the ports 15 and 15*a*. The liquid of the ascending flow passing through each of the ports 15 and 15*a* fills the corresponding passages 19 one after another, first the length 20 and then the length 21, as if being scooped up by each of the ports 14 of the outward cylinder 9 in succession when said port dips below the surface of liquid in the casing 1 of the apparatus during the rotation of the contrivance 7. As said contrivance continues to rotate, the next port 14 of the outward cylinder 9 rises to the surface of the liquid while the corresponding passage 19, which is at the bottom, appears to be filled with liquid up to the brim, and said liquid starts draining through the passage 15 or 15*a* directly into the bore of the contrivance 7, thereby producing an ascending flow of liquid in said port 15 or 15*a*. Thus, the liquid is fed due to the rotation of the contrivance 7 as if being pumped into the bore of said contrivance from the expanded body 1*a* of the casing 1 by means of the passages 19.

Since the revolving screen 2 is made of wire mesh, the flow of liquid under the steady-state conditions is at a level which is even with the level of liquid in the casing 1. When the liquid contained in the revolving screen 2 passes through the wire mesh, it carries away the smaller particles of trash which settle then to the bottom of the part 1*b* of the casing 1 from where the helical ribbon 6 at the outside surface of the revolving screen 2 carries them into the expanded body 1*a* of the casing 1. Now, as a successive port 14 is dipped below the surface of liquid, the smaller particles of the settled trash are scooped up by said port from said body 1*a* together with the liquid and discharged, also with the liquid, into a passage 19 from which they progress successively over its lengths 21 and 20 and join the coarser particles admitted through the corresponding port 15 or 15*a* when this port has been in its lowermost position. When a successive passage 19 and, consequently, the successive inward port 15 or 15*a* emerge from below the surface of liquid, by that time all the liquid contained in the passage 19 has drained into the bore of the contrivance 7, the heavy trash which has been already admitted through the port 14 and the port 15 or 15*a* accumulates on the longitudinal partition 18 and, as the revolving screen continues to rotate integrally with the contrivance 7, is lifted by the longitudinal partition 18 into a position where the angle of inclination thereof exceeds the angle of repose of said trash. At this instant the trash starts rolling down the partition and reaches the chute 28 by way of the port 15 or 15*a*, and is then discharged from the apparatus.

The ascending flow of liquid produced during each dipping of a port 15 or 15*a* prevents the tubers or root crop cleaned from entering the length 20 of the passage 19 through the port 15 or 15*a*. To enhance the separation of the coarser trash with particles of a size somewhat greater than the meshes of the revolving screen 2, there is provided the port 15*a* wherein the velocity of the ascending flow is by far smaller than required in order to maintain suspended the tubers or root crop cleaned. Said tubers or crop are prevented from entering the length 20 of the passage 19 through the port 15*a* by the grating 23 comprised of the rods 24 spaced apart by a distance which is somewhat smaller than the size of the tubers or root crop cleaned. The grating 23 is fitted so that a gap, sufficiently wide to enable the trash separated to pass therethrough during a successive discharge from the length 20 of the corresponding passage 19 through the port 15, is provided between the rear edge of the port 15*a* and the free ends of the bars 24.

The chute 25 with the grating 26 made up of the bars 27 provides for a more effective separation of the heavy trash in the apparatus, the smaller particles before all, which is carried by the flow over the bottom of the flume 8. This is achieved by diverting said heavy particles from the flow carrying tubers or root crop along with trash by way of the grating 26 and the chute 25 into the expanding body 1*a* of the casing 1 before they reach the revolving contrivance from which the trash is discharged by means of the corresponding port 14 which scoops it up during the successive dipping of a passage 19 below the level of liquid. The tubers or root crop carried by the liquid pass through the apparatus by way of the narrowing portion 1*e* of the casing 1 and are disposed of through the flume 8.

As it will be noted, the apparatus disclosed requires no additional supply of water for producing the ascending flow in the ports which catches the separated heavy trash and assures an effective separation of heavy trash with particles of all sizes.

A pilot model of the apparatus for the separation of trash from less heavy firm articles in a flow of liquid made in accordance with the present invention has passed comprehensive testing. The results have proved a comparatively complete separation of trash amounting to almost 98 percent in dealing with stones of coarse and fine fractions when such trash abounds in the tubers or root crop cleaned.

Compared with other apparatus, the apparatus disclosed displays a high capacity which provides for separation of as many as 300 t of trash per 24 hours.

The fact that an almost complete separation of trash is achievable reduces the requirements for cutting tools employed for the processing of the tubers or root crop cleaned.

The apparatus provided in accordance with the present invention is of comparatively simple construction and is reliable in operation.

It goes without saying that various modifications within the scope of the invention may occur to those skilled in the art and can be incorporated into the apparatus disclosed, the foregoing description whereof being given exclusively as a limitless example.

What is claimed is:

1. An apparatus for the separation of trash from less heavy firm articles in a flow of liquid comprising: a trough-shaped casing; a source of liquid communicating with said trough-shaped casing; a revolving screen located essentially horizontally in said trough-shaped casing; a drive of said revolving screen to actuate said screen; members to impart motion to trash mounted on said screen; a contrivance for the separation, feeding and discharging of trash located in said trough-shaped casing and attached to said revolving screen at an end where the flow of liquid carrying the uncleaned articles enters said screen and, comprising: an outward cylinder; an inward cylinder of a diameter which is somewhat greater than the diameter of said revolving screen; at least one additional cylinder interposed coaxially between said outward and inward cylinders, ports being provided in said outward cylinder for feeding the outflow of liquid with relatively small trash from said revolving screen into said contrivance, ports being provided in said inward cylinder for feeding the relatively big trash and discharging all the trash separated, ports being provided in said additional cylinder; and partitions along the longitudinal axis of said contrivance between said inward and additional cylinders so that said ports of the inward cylinder and said ports of said additional cylinders are next to each said partition on either side thereof, said partitions serving to accumulate trash thereon; wherein at least three passages are defined between said inward, outward and additional cylinders, said passages extending transversely with respect to the longitudinal axis of said contrivance, each of said passages being provided with a first length defined by the side surfaces of the outward and said additional cylinders and with a second length defined by the side surfaces of said additional cylinder and the inward cylinder, said first length communicating with said second length by a corresponding port of said additional cylinder, each of said passages opening into a corresponding port of said inward cylinder with one of its ends and into a corresponding port of said outward cylinder with another end, each of said passages being of essentially constant cross-sectional area along the entire length, and each of said passages having a length essentially equal to half the circumference of the outward cylinder.

2. The apparatus as in claim 1, wherein said first and second lengths of each passage are displaced relative to each other along the longitudinal axis of said contrivance so that said first length is located within its width behind the second length of another of said passages along the longitudinal axis of said contrivance.

3. The apparatus as in claim 1, wherein at least one port of said additional cylinder has an area which is less than the area of each port of the inward cylinder, and one of said ports of the inward cylinder has an area which is greater than the area of each of the remaining ports of the inward cylinder and is provided with a grating.

4. The apparatus as in claim 3, wherein the grating is formed by bars which are bent to a radius somewhat smaller than the radius of the inward cylinder, extend in a direction which is essentially transverse to the longitudinal axis of said contrivance and are attached at one end to an edge of one of said ports in the inward cylinder, the other ends being free and separated from the opposite edge of a respective port by a gap, the bars being of longitudinally changing cross-sectional area which gradually diminishes towards the free ends.

5. The apparatus as in claim 1, wherein a chute is provided at the end of the apparatus entering which is the flow of liquid carrying the uncleaned firm articles, said chute being attached to said trough-shaped casing of the apparatus so as to divert some of the flow of liquid directly into said passages of said contrivance and being provided with a grating fitted essentially horizontally to the upper open part of the chute.

6. The apparatus as in claim 5, wherein the grating of the chute is formed by bars extending along the longitudinal axis of said contrivance and attached at one end to the chute, the other ends being free and separated from said trough-shaped casing of the apparatus by a gap, the bars being of a longitudinally changing cross-sectional area which gradually diminishes towards the free ends.

* * * * *